US011668174B2

(12) United States Patent
Beuterbaugh et al.

(10) Patent No.: US 11,668,174 B2
(45) Date of Patent: Jun. 6, 2023

(54) SIMULFRAC PULSED TREATMENT

(71) Applicant: Halliburton Energy Services, Inc., Houston, TX (US)

(72) Inventors: Aaron Michael Beuterbaugh, Spring, TX (US); Philip D. Nguyen, Houston, TX (US); Stanley V. Stephenson, Duncan, OK (US); Jonathan Smith, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 52 days.

(21) Appl. No.: 17/419,216

(22) PCT Filed: Jan. 10, 2019

(86) PCT No.: PCT/US2019/013063
§ 371 (c)(1),
(2) Date: Jun. 28, 2021

(87) PCT Pub. No.: WO2020/145978
PCT Pub. Date: Jul. 16, 2020

(65) Prior Publication Data

US 2022/0112797 A1 Apr. 14, 2022

(51) Int. Cl.
*E21B 43/26* (2006.01)
*E21B 34/02* (2006.01)
(Continued)

(52) U.S. Cl.
CPC ..... *E21B 43/2607* (2020.05); *E21B 34/02* (2013.01); *E21B 43/12* (2013.01); *E21B 43/16* (2013.01); *E21B 43/247* (2013.01)

(58) Field of Classification Search
CPC ..... E21B 43/2607; E21B 34/02; E21B 43/12; E21B 43/16; E21B 43/247
See application file for complete search history.

(56) References Cited

U.S. PATENT DOCUMENTS 4,718,490 A 1/1988 Uhri
4,830,106 A 5/1989 Uhri
(Continued)

FOREIGN PATENT DOCUMENTS

WO 2017176268 10/2017
WO 2017223007 12/2017
WO WO-2017223007 A1 * 12/2017 ..... E21B 47/06

OTHER PUBLICATIONS

International Search Report and Written Opinion issued in corresponding PCT International Application No. PCT/US2019/013063; dated Oct. 10, 2019.

*Primary Examiner* — James G Sayre
(74) *Attorney, Agent, or Firm* — McGuireWoods LLP

(57) ABSTRACT

A method and system pulse for treating a plurality of wells simultaneously includes applying a high pressure of fracturing fluid to one or more switching valves and repeatedly opening and closing the one or more switching valves to divert the fracturing fluid near instantaneously from one well to the other well to creating a pulse wave into the plurality of wells for fracturing subterranean formations. The one or more switching valves may be a single 3-way valve incorporating the function of two or more switching valves. This technique reduces wear of surface equipment including high pressure pumps that need only provide a constant pressure.

20 Claims, 6 Drawing Sheets

(51) Int. Cl.

| | |
|---|---|
| ***E21B 43/12*** | (2006.01) |
| ***E21B 43/16*** | (2006.01) |
| ***E21B 43/247*** | (2006.01) |

(56) References Cited

U.S. PATENT DOCUMENTS

| | | | | |
|---|---|---|---|---|
| 9,945,216 | B2 | 4/2018 | Ghasripoor et al. | |
| 2009/0114392 | A1 | 5/2009 | Tolman et al. | |
| 2010/0272515 | A1 | 10/2010 | Curlett | |
| 2014/0352968 | A1* | 12/2014 | Pitcher | E21B 43/26 166/308.1 |
| 2016/0123127 | A1* | 5/2016 | Walls | E21B 21/106 166/244.1 |
| 2017/0130555 | A1* | 5/2017 | Kajaria | E21B 33/068 |
| 2018/0179848 | A1* | 6/2018 | Cherewyk | E21B 43/267 |
| 2020/0048980 | A1* | 2/2020 | Jespersen | E21B 34/02 |

* cited by examiner

SIMULFRAC PULSED TREATMENT

BACKGROUND

The present disclosure relates generally to pulsed fractured treatment of subterranean formations of wells, among other features.

Oil and natural gas are generally extracted from fissures or other activities created in subterranean strata. To improve extraction of these resources, a well may be subjected to a fracturing process that promotes creation of fractures in a rock formation.

Pulse fracturing is often used to create or enhance fractures in a rock formation, but one drawback is the increased strain on surface equipment such as hydraulic high pressure pumps, along with associated gear boxes and diesel engines. Traditional pulse fracturing often leads to increased rate of equipment failure due to the pulsing nature of the fracturing process.

By reducing the amount of strain on the surface equipment, more effective use of the surface equipment such as, for example, the high pressure pumps, blender, manifolds and valves can be achieved, along with lowering the rate of equipment failure.

BRIEF DESCRIPTION OF THE DRAWINGS

Illustrative embodiments of the present disclosure are described in detail below with reference to the attached drawings, which are incorporated by reference herein, and wherein.

Figure 1:
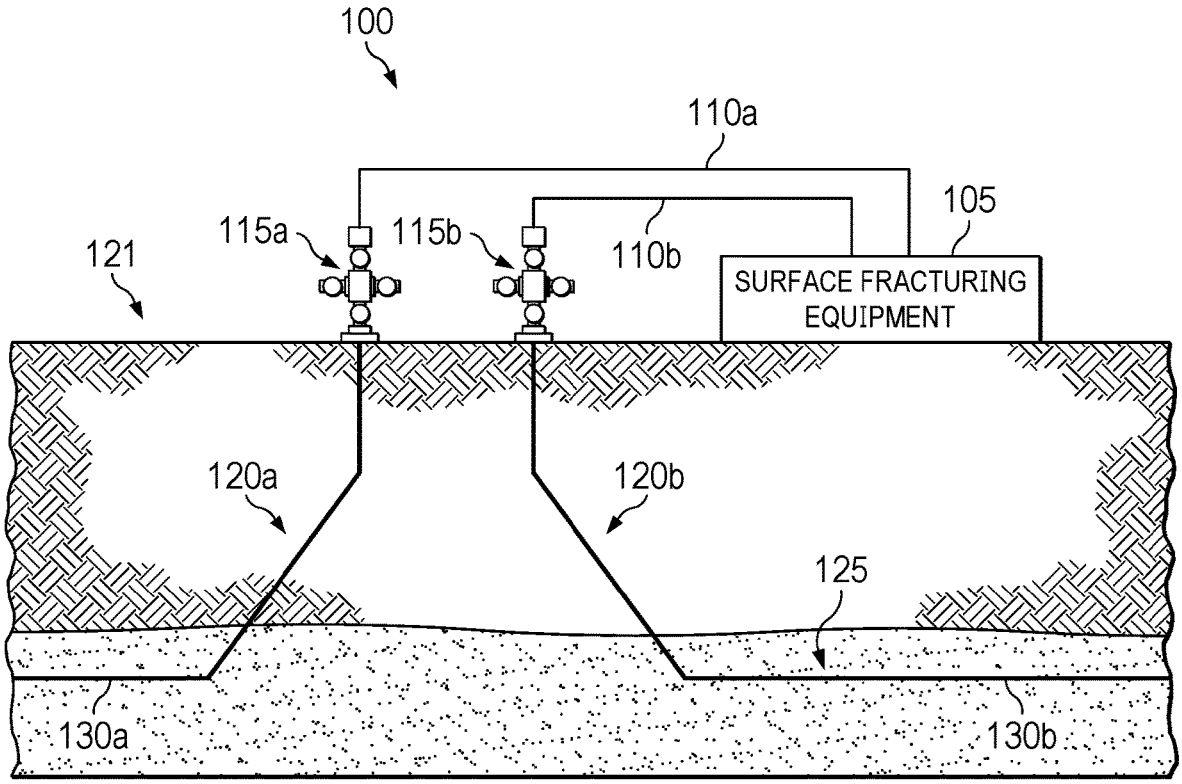
FIG. 1 is a generalized schematic view of a plurality of wells in a subterranean formation along with an example system of associated wellheads and surface fracturing equipment, according to principles of the disclosure.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the disclosed subject matter, and it is understood that other embodiments may be utilized and that logical structural, mechanical, electrical, and chemical changes may be made without departing from the spirit or scope of the disclosure. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

As used herein, the singular forms "a", "an," and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to." "Downhole" refers to a direction towards the end or bottom of a well. "Downstream" generally refers to a direction generally towards a wellhead, or towards the end or bottom of a well. The terms "about" or "substantially" refers to within +/−10%, unless context indicates otherwise.

The present disclosure relates generally to pulsed fractured treatment of subterranean formations of a plurality of wells. More particularly, the present disclosure relates generally to simultaneous pulsed fractured treatment of a plurality of wells in subterranean formations to reduce wear and equipment failure due to increased or decreased pulsing pumping strain typically associated with traditional fracturing techniques. The system and method herein provides for near instantaneous switching of a single-mode high pressure fracturing fluid to allow two or more wells to be pulsed simultaneously by a single source of high pressure fracturing fluid. The high pressure fracturing fluid is pulsed by using one or more high pressure valves to alternate fluidic flow between two or more wells. This intermittent flow, i.e., pulsed flow, is isolated in an alternating fashion solely to a single well among a plurality of wells, thus leading to increased efficiency in surface equipment and reducing equipment wear. The alternating operation between a plurality of wells leads to multi-well pulsed completions and more effective use of blender, pumps, manifolds and the like at the surface. Moreover, in this way, the surface equipment can service and complete multiple wells often without having to be moved, or disconnected and reconnected again.

Referring to FIG. 1, a generalized schematic view for a system 100 of a plurality of wells 120*a*, 120*b* in a subterranean formation 125, along with associated wellheads 115*a*, 115*b* connected to surface fracturing equipment 105 located at the surface 121. The wells 120*a* and 120*b* are depicted as horizontal wells 130*a*, 130*b* but do not need to be a horizontal well, and could take other forms, e.g., a vertical well. The surface equipment 105 may be interconnected to the wellheads 115*a*, 115*b* using corresponding conduits 110*a*, 110*b* for conveying hydraulic fracturing fluid to the wells 120*a*, 120*b*.

The hydraulic fracturing fluid may include, for example, water or another liquid mixed with sand or other proppants. The fracturing fluid may be proppant-laden or proppant-free.

The fracturing fluid is pumped into subterranean formation 125 to extend or create fractures in subterranean formation 125 and fill the fractures with proppants, which operationally hold open the fractures after pumping of the fracturing fluid has stopped. This permits formation 125 hydrocarbon fluids to more easily flow into the wells 120*a*, 120*b*. In some well completion operations, fracturing fluid used in the wells 120*a*, 120*b* can include other additives. For example, the fracturing fluid can include acidic chemicals, alkaline chemicals, polymers, or other agents to increase viscosity of the fracturing fluid.

Figure 2:
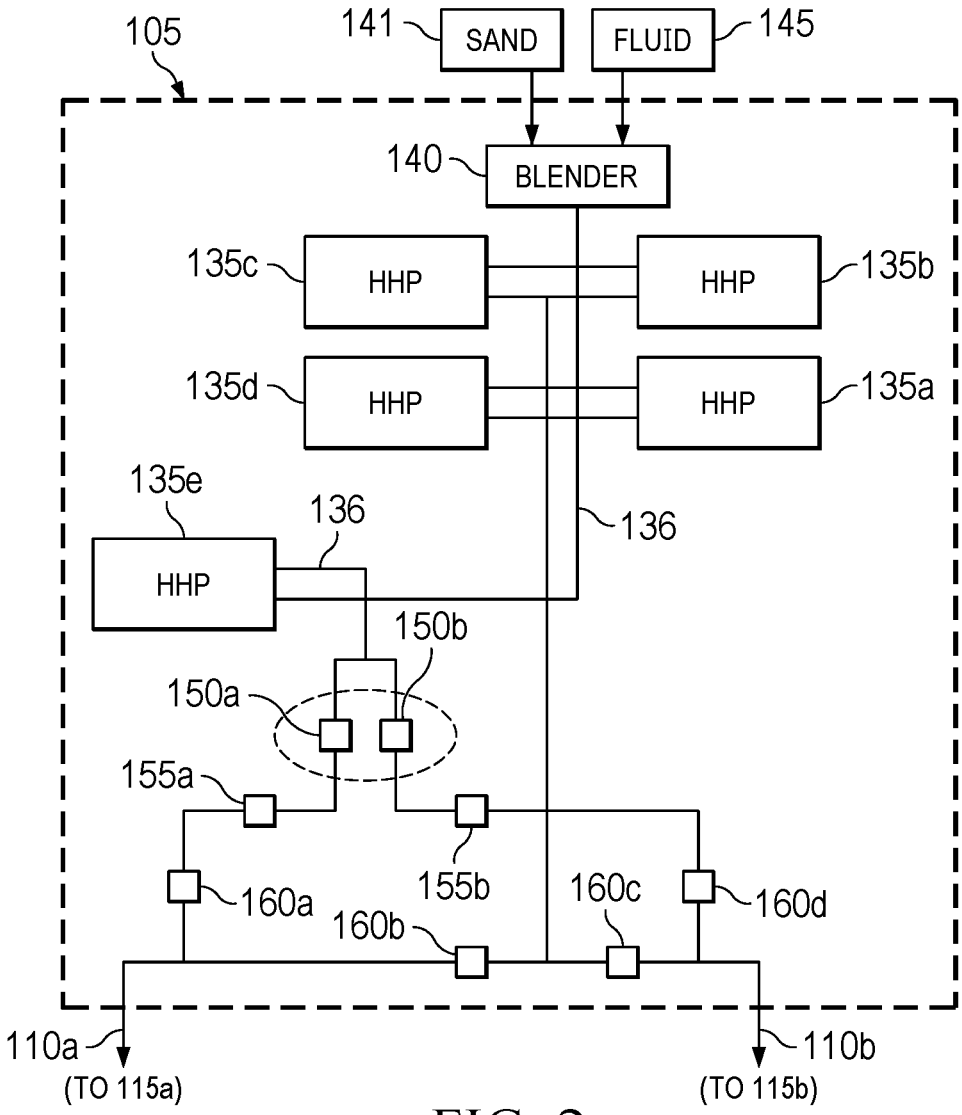
FIG. 2 is a schematic view of an embodiment of certain surface fracturing equipment, according to principles of the disclosure.

Referring to FIG. 2, the surface fracturing equipment 105 is shown in more detail. The surface fracturing equipment 105 in this example includes a one or more high pressure pumps 135*a*-135*e*, a blender 140, one or more switching valves 150*a*, 150*b*, plug switching valves 155*a*, 155*b*, and flapper checks 160*a*-160*d*. The blender 140 accepts raw materials such as sand 141, base fluid 145 that may include other additives, and provides blended fracturing fluid to the one or more pulse pumps 135*a*-135*e* via high pressure conduits 136. The one or more high pressure pumps 135*a*-135*e* run at a constant rate to provide a substantially constant pressure of the blended fracturing fluid to the one or more switching valves 150*a*, 150*b* via conduits 136. The number of high pressure pumps and total flow rate from the one or more high pressure pumps 135*a*-135*e* determine the pulse size of the fracturing fluid that are selectively diverted to the plurality of wells 120*a*, 120*b* by one or more switching valves 150*a*, 150*b*. Because the one or more high pressure pumps 135*a*-135*e* can run at a constant rate, the wear and tear on the pumps is significantly reduced.

The one or more switching valves 150*a*, 150*b* alternatively redirect the fracturing fluid received via high pressure conduit 136 from the one or more high pressure pumps 135*a*-135*e* from one wellhead 115*a* to another wellhead 115*b*. Downstream of each of the one or more switching valves 150*a*, 150*b* are plug valves 155*a*, 155*b*. The plug valves 155*a*, 155*b* allow absolute shut off of fracturing fluid flow after one of the switching valves 150*a*, 150*b* shifts to a closed position in case there is some leakage flow from the associated switching valve 150*a*, 150*b* due to wear thereby causing leakage. The fracturing fluid received via high pressure conduit 136 may be conveyed at 1000 psi or more.

Downstream of the plug valves 155*a*, 155*b*, flapper checks 160*a*-160*d* are strategically placed along conduits 110*a*, 110*b* as required to prevent an unexpected well control situation if the high pressure conduits 110*a*, 110*b*, 136 to the one or more high pressure pumps 135*a*-135*e* or the high pressure pumps 135*a*-135*e* themselves were to develop a leak. The fracturing fluid flows downstream from flapper checks 160*a*-160*d* through downstream high pressure conduits 110*a*, 110*b* to the plurality of wellheads 115*a*, 115*b*, then onward to the respective well 120*a*, 120*b*, as determined by the state of the one or more switching valves 150*a*, 150*b*.

Figure 3A:
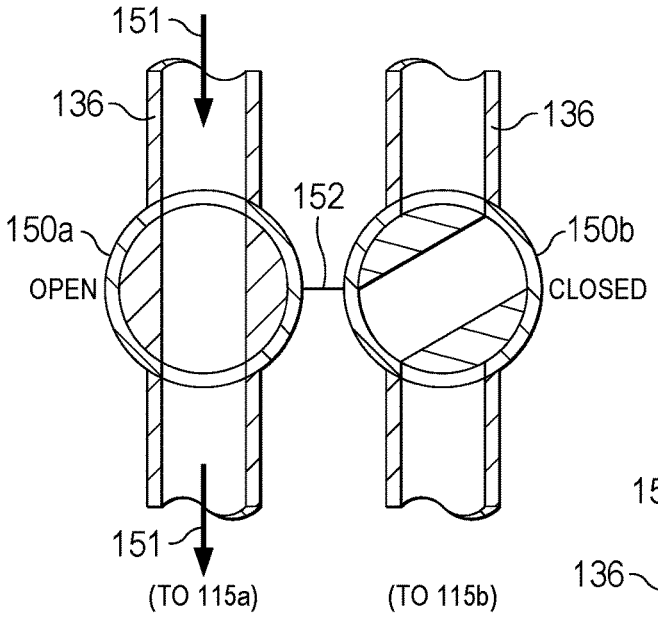
FIG. 3A-3C are examples of valves of FIG. 2 in different stages of opening and closing, according to principles of the disclosure.
Figure 3B:
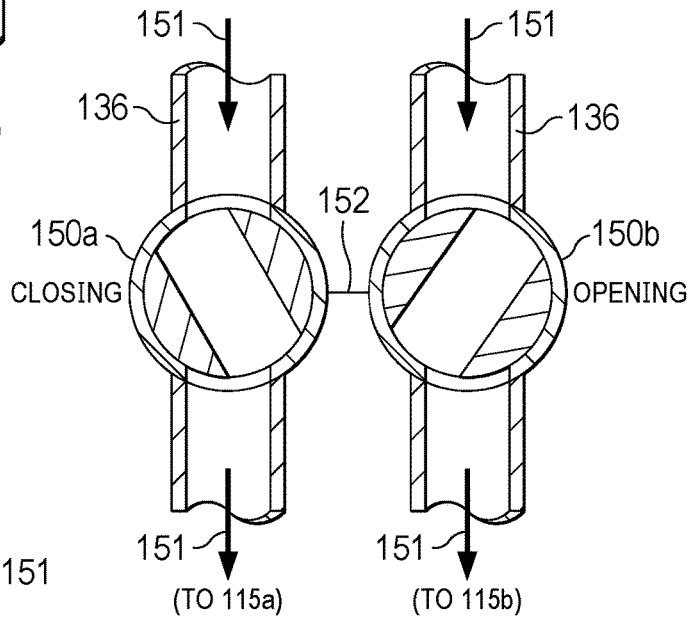
Figure 3C:
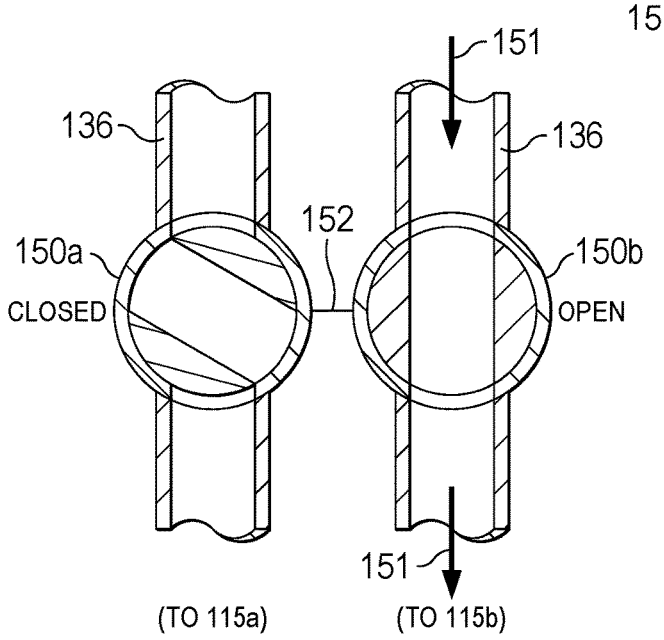

Referring to FIGS. 3A to 3C, sequencing control of the one or more switching valves 150*a*, 150*b* include, as a first state, opening switching valve 150*a* and plug valve 155*a* such that the flow rate of the fracturing fluid 151 from the one or more high pressure pumps 135*a*-135*e* is directed to the first wellhead 115*a*, delivering a pulse, while switching valve 150*b* and associated plug valve 155*b* are closed preventing fluid flow 151 to the second wellhead 115*b*, as shown in FIG. 3A. Next, as shown in FIG. 3B, a pulse of fluid flow 151 is directed to the second wellhead 115*b* by first opening the plug valve 155*b* downstream of switching valve 150*b*, then switching valve 150*b* is opened as switching valve 150*a* is being closed. Generally, the speed of the transition from open position to closed position of the switching valves 150*a*, 150*b* dictates the pulse amplitude directed to the respective well 120*a*, 120*b*. After switching valve 150*b* is fully opened and switching valve 150*a* is fully closed, as shown in FIG. 3C, initiating a pulse down well 120*b*, the plug valve 155*a* downstream of switching valve 150*a* is closed. The process is then reversed to send a pulse towards wellhead 115*a* and to well 120*a*.

The time duration that a switching valve 150*a*, 150*b* is opened can vary, or can be maintained of a constant duration from cycle to cycle. The time may be selected from a range of about 100 ms to about 10 secs. Moreover, the time duration of a pulse created may be equal for each well 120*a*, 120*b*, or the time duration of a pulse may be unequal for one well 120*a*, 120*b* compared to the other well. The control of the one or more switching valves 150*a*, 150*b* may be achieved manually, hydraulically, or may be accomplished by a computerized controller, such as shown in FIG. 4.

Figure 4:
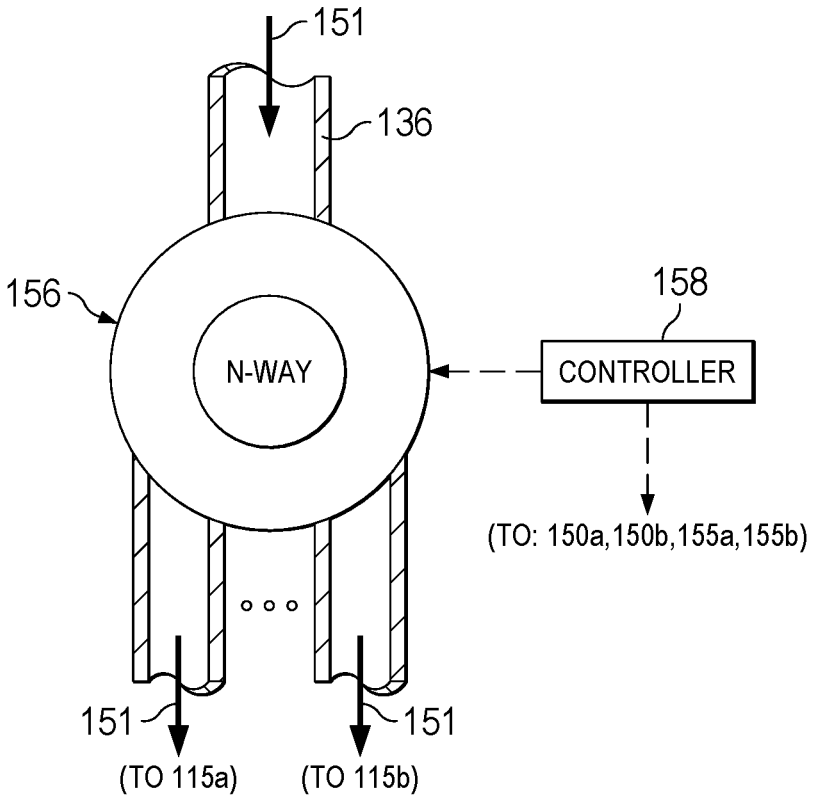
FIG. 4 is an illustration of a multi-way valve, according to principles of the disclosure.

As shown in reference to FIG. 4, switching valves 150*a*, 150*b* may be incorporated into a single N-way valve 156 for controlling multiple outgoing flows to multiple wellheads. Valve 156 can be a 3-way valve. If separate valves are implemented as shown in FIGS. 3A-3C, then a linkage 152 can be connected between the two to keep them synchronized in relation to one another so that as one valve changes, the other valve changes in proportionate manner. Alternatively, another method to keep the switching valves 150*a*, 150*b* synchronized is to employ a rotary actuator with a through shaft that could have one valve above the actuator and the other below the actuator such that one is opening while the other is closing, and vice versa.

As the one or more switching valves 150*a*, 150*b* cause fluid flow to shift from one well 120*a*, 102*b* to the other, the rate of opening the flow to one well and closing to the other will have an impact on the pulse seen by each well 120*a*, 120*b*. When a flow starts to flow into a first well, a positive waterhammer wave going to that first well is created while a rarefaction wave is created in the second well due to the sudden drop in the flow rate to the second well. The overlap of fluid flows to each well 120*a*, 120*b* can be controlled to optimize the downhole pressure waves and minimize the surface impacts.

FIG. 4 is an illustration of an example N-way switching valve 156. This can be a 3-way switching valve. In essence, the N-way switching valve 156 incorporates the functionality of two or more independent switching valves 150*a*, 150*b* into one single unit. The switching valves 150*a*, 150*b* and N-way switching valve 156 can be operatively controlled by a controller 158. The controller 158 may also control any of the switching valves 150*a*, 150*b*, the N-way switching valve 156, and may control any or all of the other components, including any of the blender 140, plug valves 155*a*, 155*b*, flapper checks 160*a*-160*d*, and the high pressure pumps 135*a*-135*e*. The controller 158 may comprise a computer processor connected by a bus to a memory. The memory may include a software program for performing the control and operational sequencing of the components, including the sequencing of opening and closing the switching valves 150*a*, 150*b*, 156, plug valves 155*a*, 155*b*, and flapper checks 160*a*-160*d*.

Figure 5:
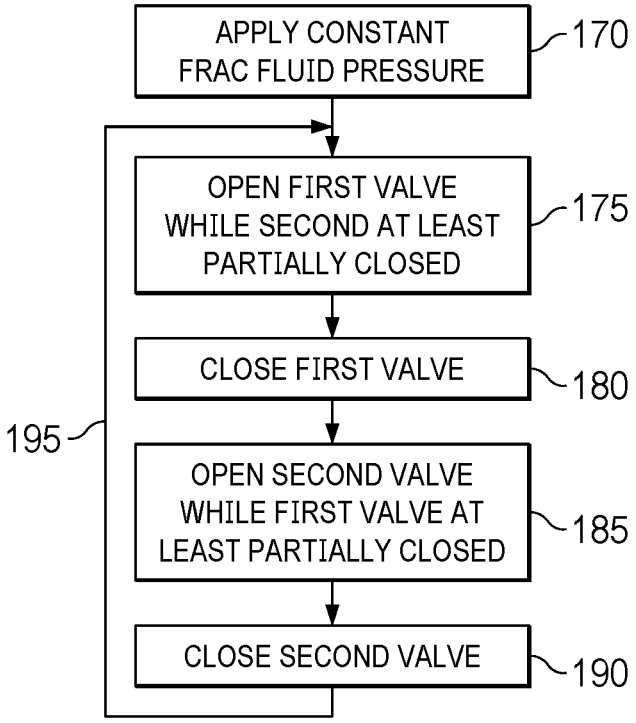
FIG. 5 is a flow diagram of steps of performing a pulsed treatment of a plurality of wells, according to principles of the disclosure.

FIG. 5 is an example flow diagram of steps for performing a pulsed treatment of a plurality of wells, according to principles of the disclosure. The flow diagram of FIG. 5 may employ the system or components shown in FIGS. 1-4. At step 170, a constant pressure of fracturing fluid is provided to one or more switching valves switching valves 150*a*,

150*b*, or N-way valve 156. The constant pressure is provided by one or more high pressure pumps 135*a*-135*e*. The switching valves 150*a*, 150*b*, or N-way valve 156, are connected to a plurality of wellheads 115*a*, 115*b*. A step 175, a first switching valve 150*a* is opened or opening while a second valve 150*b* is at least partially closed, or closing, permitting the fracturing fluid to flow to a first wellhead 115*a* associated with a first well 120*a*. A first time period is started to time a duration of a created pulse in the first well 120*a*. The second switching valve 150*b* is connected to the second wellhead 115*b* associated with a second well 120*b* for treating the plurality of wells simultaneously. As a sub-step, a first plug valve 155*a* is opened before opening the first valve 150*a*.

At step 180, the first switching valve 150*a* is closed at the end of a first predetermined time period. As a sub-step, the first plug valve 155*a* is closed. At step 185, a second switching valve is opened. At step 185, a second switching valve 120*b* is opened, while the first switching valve 120*a* is at least partially closed or closing. As a sub-step, a second plug valve 155*b* is opened before opening of the second switching valve. A second time period is started to time a duration of a created pulse in the second well 120*b*. At step 190, the second switching valve 120*b* is closed at the end of the predetermined second time period. As a sub-step, the second plug valve 155*b* is closed. At step 195, the process may be continued as a new cycle by repeating steps 175, 180, 185 and 190. A new cycle can vary in time with the first time period varying in duration and/or the second time period varying in duration from one cycle to a next cycle. The first time period and the second time period may be predetermined and selected from a range of about 100 ms to about 10 secs. In some applications, the first time period and the second time period may be selected from a range of about 500 ms to about 8 secs. In some applications, the first time period and the second time period may be selected from a range of about 800 ms to about 5 secs. In some applications, the first time period and the second time period may be selected from a range of less than 7 secs and more than 200 ms.

Optionally, a third switching valve and associated third plug valve operatively connected to a third well head may be included in the process as separate steps that operates in similar sequential fashion after steps 185 and 190 and before steps 175 and 180.

Figure 6:
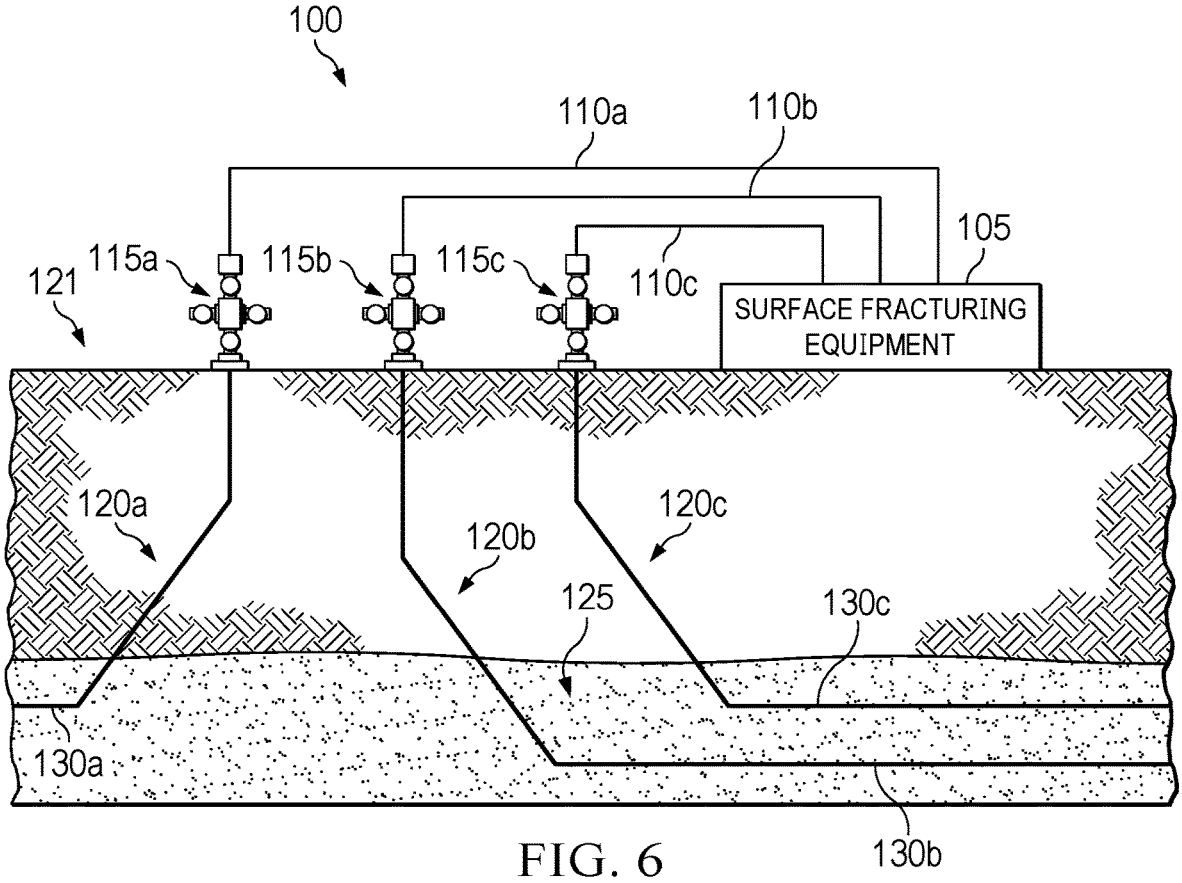

FIG. 6 is a generalized schematic view of the system 100 of FIG. 1, but also contains well 120*c* in addition to wells 120*a*, 120*b* in a subterranean formation 125, along with associated wellhead 115*c* which is connected to surface fracturing equipment 105 located at the surface 121. Well 120*c* is depicted as a horizontal well 130*c* but does not need to be a horizontal well, and could take other forms, e.g., a vertical well. The surface equipment 105 may be interconnected to the wellhead 115*c* using corresponding conduit 110*c* for conveying hydraulic fracturing fluid to the well 120*c*.

Figure 7:
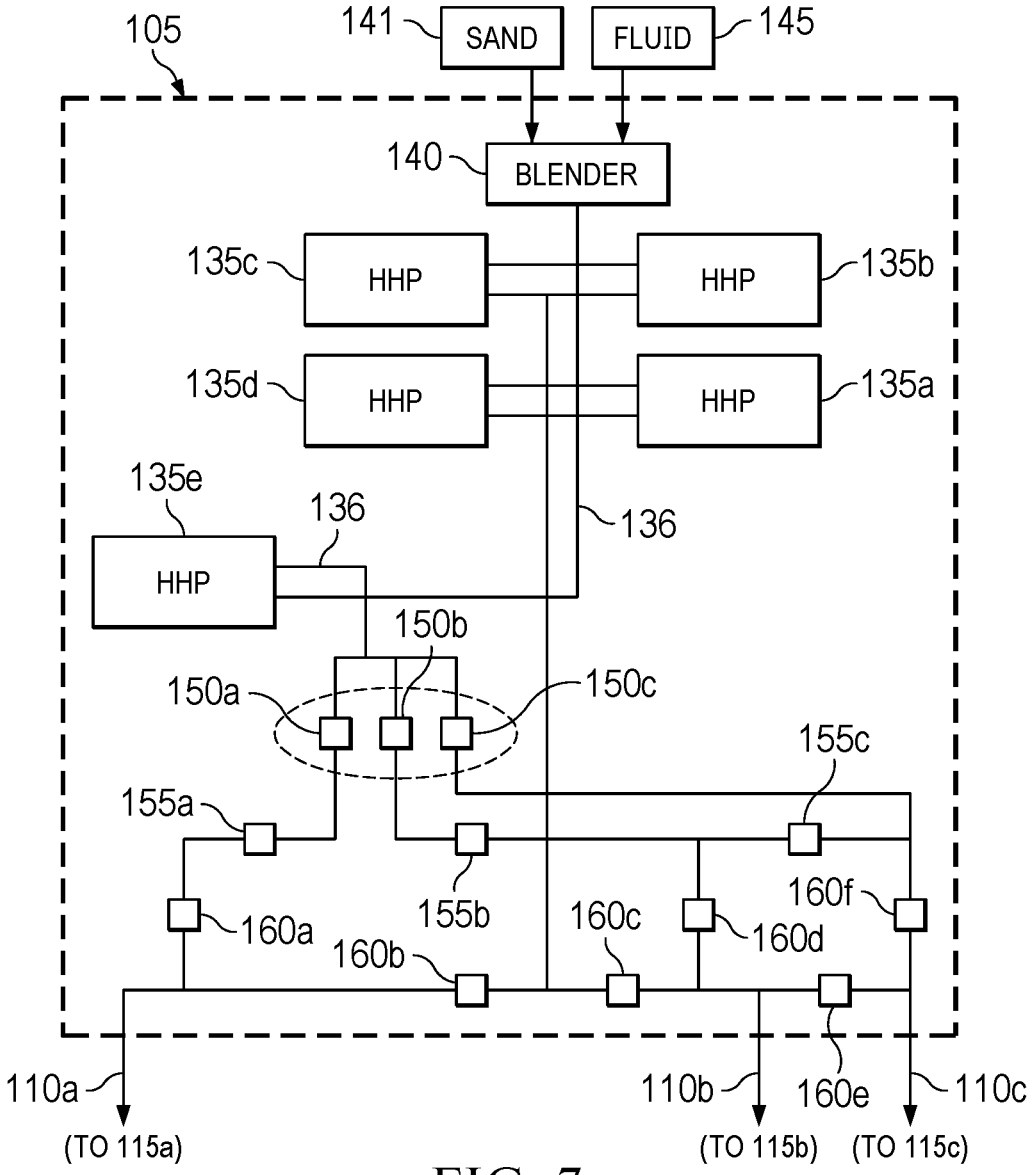

FIG. 7 is a generalized schematic view of the surface fracturing equipment 105 of FIG. 2 but modified to include a third switching valve 150*c* which is fluidically coupled to wellhead 115*c* (as illustrated in FIG. 6) via conduit 110*c*. Plug valve 155*c* allows absolute shut off of fracturing fluid flow after switching valve 150*c* shifts to a closed position in case there is some leakage flow from the associated switching valve 150*c* due to wear thereby causing leakage. Downstream of plug valve 155*c* are flapper checks 160*e* and 160*f* which are strategically placed along conduit 110*c* as required to prevent any unexpected well control situations.

The following clauses are additional descriptions of various aspects of the disclosure.

Clause 1: a method of hydraulic fracturing a plurality of wells, comprising a) applying a constant pressure of fracturing fluid to a plurality of switching valves including a first switching valve connected to a first wellhead associated with a first well and a second switching valve connected to a second wellhead associated with a second well for treating the plurality of wells simultaneously;

b) opening the first switching valve while the second switching valve is a least partially closed permitting the fracturing fluid to flow to the first wellhead and first well for a first time period;

c) closing the first switching valve at the end of the first period;

d) opening the second switching valve while the first valve is at least partially closed for a second time period permitting fluid to flow to the second wellhead and second well during the second time period;

e) closing the second switching valve at the end of the second period; and repeating steps b) to e) to create a cycle of alternating pulsed pressure wave in the first well for fracturing a subterranean formation associated with the first well and a pulsed pressure wave in the second well for fracturing a subterranean formation associated with the second well.

Clause 2: the method of clause 1, wherein in step b) the second switching valve is fully closed during the first time period.

Clause 3: the method of clause 1, wherein in step d) the first switching valve is fully closed during the second time period.

Clause 4: the method of clause 1, wherein step b) includes opening a first plug valve located between the first switching valve and the first wellhead, before opening the first switching valve.

Clause 5: the method of clause 4, wherein step c) includes closing the first plug valve.

Clause 6: the method of clause 1, wherein step d) includes opening a second plug valve positioned between the second switching valve and the second wellhead, before opening the second switching valve.

Clause 7: the method of clause 6, wherein step e) includes closing the second plug valve.

Clause 8: the method of clause 1, wherein the first time period is equal to the second time period.

Clause 9: the method of clause 1, wherein the first time period is not equal to the second time period.

Clause 10: the method of clause 1, wherein the duration of the first time period or a duration of second time period varies from at least one cycle to at least another cycle.

Clause 11: the method of clause 1, wherein the first time period or second time period is selected from the range of 100 ms to about 10 secs.

Clause 12: the method of clause 1, further comprising:

applying the constant pressure of fracturing fluid to a third switching valve connected to a third wellhead associated with a third well for simultaneously treating the plurality of wells including the first well, the second well and the third well;

after each step e) but before each repeated step b), performing:

m) opening the third switching valve while the second switching valve is a least partially closed permitting the fracturing fluid to flow to the third wellhead and third well for a third time period; and n) closing the third switching valve at the end of the third period for create a pulsed pressure wave in the third well for fracturing a subterranean formation associated with the third well.

Clause 13: the method of clause 1, wherein the applying the constant pressure of fracturing fluid to the plurality of wells is supplied by one or more pumps.

Clause 14: a method of hydraulic fracturing a plurality of wells, comprising:

alternating application of a constant pressure of fracturing fluid to a plurality of wellheads by opening and closing at least one switching valve to create a pulsed pressure wave in each well associated with the plurality of wellheads for fracturing a subterranean formation associated with each well.

Clause 15: the method of clause 14, wherein the pulse pressure wave is created by opening and closing the at least one switching valve to re-direct the constant pressure of fracturing fluid after a first application period from a first well of the plurality of wells to at least one other subsequent well.

Clause 16: the method of clause 15, further comprising:

redirecting the constant pressure of fracturing fluid after a second application period time period from the at least one subsequent well back to the first well or another at least one subsequent well.

Clause 17: the method of clause 16, wherein the first time period substantially equals the second time period.

Clause 18: the method of clause 16, wherein the at least one valve is a plurality of switching valves.

Clause 19: a system for hydraulic fracturing a plurality of wells, comprising:

at least one pump to supply a constant pressure of fracturing fluid to a plurality of wells each having a wellhead; and at least one switching valve connected between the at least one pump and each of the plurality of wellheads, the at least one valve operable to alternate application of the constant pressure of fracturing fluid to the plurality of wellheads by opening and closing the at least one switching valve to create a pulsed pressure wave in each well associated with the plurality of wellheads for fracturing a subterranean formation associated with each well.

Clause 20: the system of clause 19, wherein the at least one switching valve is a plurality of switching valves with one of the plurality of switching valves connected to each wellhead, the plurality of switching valves synchronized to permit alternating flow of the constant pressure of fracturing fluid in each of the plurality of wells for a predetermined time period causing the pulsed pressure wave in each well.

While this specification provides specific details related to providing simultaneous pulsed treatment of a plurality of wells, it may be appreciated that the list of components is illustrative only and is not intended to be exhaustive or limited to the forms disclosed. Other components will be apparent to those of ordinary skill in the art without departing from the scope and spirit of the disclosure. Further, the scope of the claims is intended to broadly cover the disclosed components or steps and any such components or steps that are apparent to those of ordinary skill in the art.

It should be apparent from the foregoing disclosure of illustrative embodiments that significant advantages have been provided. The illustrative embodiments are not limited solely to the descriptions and illustrations included herein and are instead capable of various changes and modifications without departing from the spirit of the disclosure.

What is claimed is:

1. A method of hydraulic fracturing a plurality of wells, comprising:

a) applying a constant pressure of fracturing fluid to a plurality of switching valves including a first switching valve connected to a first wellhead associated with a first well and a second switching valve connected to a second wellhead associated with a second well for treating the plurality of wells simultaneously;

b) then opening the first switching valve while the second switching valve is at least partially closed permitting the fracturing fluid to flow to the first wellhead and first well for a first time period from a pump outputting the flow of fracturing fluid at a constant rate;

c) then closing the first switching valve at the end of the first period;

d) opening the second switching valve while the first valve is at least partially closed for a second time period permitting fluid to flow to the second wellhead and second well during the second time period from a pump outputting the flow of fracturing fluid at a constant rate;

e) then closing the second switching valve at the end of the second period; and repeating steps b) to e) to create a cycle of alternating pulsed pressure wave in the first well for fracturing a subterranean formation associated with the first well and a pulsed pressure wave in the second well for fracturing a subterranean formation associated with the second well.

2. The method of claim 1, wherein in step b) the second switching valve is fully closed during the first time period.

3. The method of claim 1, wherein in step d) the first switching valve is fully closed during the second time period.

4. The method of claim 1, wherein step b) includes opening a first plug valve located between the first switching valve and the first wellhead, before opening the first switching valve.

5. The method of claim 4, wherein step c) includes closing the first plug valve.

6. The method of claim 1, wherein step d) includes opening a second plug valve positioned between the second switching valve and the second wellhead, before opening the second switching valve.

7. The method of claim 6, wherein step e) includes closing the second plug valve.

8. The method of claim 1, wherein the first time period is equal to the second time period.

9. The method of claim 1, wherein the first time period is not equal to the second time period.

10. The method of claim 1, wherein the duration of the first time period or a duration of second time period varies from at least one cycle to at least another cycle.

11. The method of claim 1, wherein the first time period or second time period is selected from the range of 100 ms to about 10 secs.

12. The method of claim 1, further comprising:

applying the constant pressure of fracturing fluid to a third switching valve connected to a third wellhead associated with a third well for simultaneously treating the plurality of wells including the first well, the second well and the third well;

after each step e) but before each repeated step b), performing:

f) opening the third switching valve while the second switching valve is at least partially closed permitting the fracturing fluid to flow to the third wellhead and third well for a third time period; and g) closing the third switching valve at the end of the third period for create a pulsed pressure wave in the third well for fracturing a subterranean formation associated with the third well.

13. A method of hydraulic fracturing a plurality of wells, comprising:

alternating application of a constant pressure of fracturing fluid to a plurality of wellheads by opening and closing at least one switching valve to create a pulsed pressure wave in each well associated with the plurality of wellheads for fracturing a subterranean formation associated with each well while outputting the fracturing fluid from a pump at a constant rate into each well.

14. The method of claim 13, wherein the pulse pressure wave is created by opening and closing the at least one switching valve to re-direct the constant pressure of fracturing fluid after a first time period from a first well of the plurality of wells to at least one other subsequent well.

15. The method of claim 14, further comprising:

redirecting the constant pressure of fracturing fluid after a second time period from the at least one subsequent well back to the first well or another at least one subsequent well.

16. The method of claim 15, wherein the first time period substantially equals the second time period.

17. The method of claim 15, wherein the at least one valve is a plurality of switching valves.

18. The method of claim 15, wherein the first time period is not equal to the second time period.

19. A system for hydraulic fracturing a plurality of wells, comprising:

at least one pump to supply a constant pressure of fracturing fluid to a plurality of wells each having a wellhead and configured to output the fracturing fluid at a constant rate; and at least one switching valve connected between the at least one pump and each of the plurality of wellheads, the at least one valve operable to alternate application of the constant pressure of fracturing fluid to the plurality of wellheads by opening and closing the at least one switching valve to create a pulsed pressure wave in each well associated with the plurality of wellheads for fracturing a subterranean formation associated with each well.

20. The system of claim 19, wherein the at least one switching valve is a plurality of switching valves with one of the plurality of switching valves connected to each wellhead, the plurality of switching valves synchronized to permit alternating flow of the constant pressure of fracturing fluid in each of the plurality of wells for a predetermined time period causing the pulsed pressure wave in each well.

* * * * *